US005716263A

United States Patent [19]

Jones et al.

[11] Patent Number: 5,716,263

[45] Date of Patent: Feb. 10, 1998

[54] DEVICE FOR CLEANING, POLISHING OR SANDING

[76] Inventors: William C. Jones; Jean K. Jones, both of 209 E. Ensey St., Tuscola, Ill. 61953

[21] Appl. No.: 614,166

[22] Filed: Mar. 8, 1996

[51] Int. Cl.[6] ..... B24B 23/00

[52] U.S. Cl. ..... 451/344; 451/162; 451/351; 451/356

[58] Field of Search ..... 451/344, 356, 451/351, 162, 353, 425, 357, 359; 89/54; 173/216, 217; 192/69.8, 94; 74/413, 412 R

[56] References Cited

U.S. PATENT DOCUMENTS

| | | | |
|---|---|---|---|
| 1,588,943 | 6/1926 | Clark | 451/356 |
| 3,024,883 | 3/1962 | Eriksson | 15/28 |
| 3,378,869 | 4/1968 | Schwartz | 15/28 |
| 3,425,087 | 2/1969 | Fitzhugh | 15/28 |
| 3,932,908 | 1/1976 | Bitgood et al. | 15/28 |
| 4,005,502 | 2/1977 | Stevens | 15/22 R |
| 4,027,348 | 6/1977 | Flowers et al. | 15/22 R |
| 4,131,966 | 1/1979 | Gross | 15/28 |
| 4,137,588 | 2/1979 | Sandt et al. | 15/22 R |
| 4,158,246 | 6/1979 | Meadows et al. | 15/28 |
| 4,173,828 | 11/1979 | Lustig et al. | 433/87 |
| 4,223,418 | 9/1980 | Pedrini | 15/28 |
| 4,295,240 | 10/1981 | Lex | 15/22 R |
| 4,299,004 | 11/1981 | Lancaster | 15/97 R |
| 4,476,602 | 10/1984 | Hurn et al. | 15/28 |
| 4,489,525 | 12/1984 | Heck | 451/344 |
| 4,512,207 | 4/1985 | Dancsik | 451/356 |
| 4,574,419 | 3/1986 | Lex | 15/328 |
| 4,610,111 | 9/1986 | Cox | 51/170 MT |
| 4,823,514 | 4/1989 | DeLuca | 51/170 MT |
| 4,924,636 | 5/1990 | Hoffman | 51/170 MT |
| 5,018,314 | 5/1991 | Fushiya et al. | 51/170 MT |
| 5,187,827 | 2/1993 | Wei | 15/22.1 |
| 5,212,995 | 5/1993 | Robinson et al. | 451/356 |
| 5,224,231 | 7/1993 | Nacar | 15/22.2 |
| 5,349,786 | 9/1994 | Dorrah | 451/357 |

*Primary Examiner*—Robert A. Rose
*Assistant Examiner*—George Nguyen
*Attorney, Agent, or Firm*—Grace J. Fishel

[57] ABSTRACT

A device for cleaning, polishing or sanding having a treatment head that linearly reciprocates a pad or brush with a purely translational motion. The treatment head has a driven shaft with a crank at a free end connected through a link to a sliding block. The sliding motion of the block is confined in rails fixed on opposite sides of the driven shaft. A mechanism is provided for connecting the driven shaft to an output shaft of an electric motor.

8 Claims, 4 Drawing Sheets

DEVICE FOR CLEANING, POLISHING OR SANDING

BACKGROUND OF THE INVENTION

1. Field of the Invention

The present invention relates to a motorized device for cleaning, polishing or sanding wherein a treatment head linearly reciprocates a pad or brush with a purely translational motion. In a preferred embodiment, the treatment head is detachably coupled to the motor so that other treatment heads imparting rotary, orbital, oscillatory or the like motion may be interchangeably coupled thereto.

2. Brief Description of the Prior Art

There are many things around a kitchen or a workshop that need to be cleaned, polished or sanded. A rotary brush, for example, is preferred with glassware, whereas for other purposes an orbital or oscillatory motion is best. In some instances, like cleaning a heavily soiled baking pan, scrubbing a grate of a barbecue grill or sanding wood "with the grain", a back and forth motion is preferred. A rotary device, for example, on a baking pan tends to skate on the surface and sling off the cleaning solution whereas an oscillating or orbital motion causes vibration, only partially solved by a counter weight. While rotary, orbital and oscillatory scrubbing devices can be readily purchased, applicants are aware of no kitchen or workshop scrubber that reciprocates a pad or brush with a purely translational motion.

There are many kitchen or workshop scrubbing, cleaning or polishing devices, on the market and/or patented, that witness the fact that homeowners like the convenience of them. Cleanup chores are especially a problem for many housewives even without physical impairments and there are over seventeen million adults suffering with some degree of arthritis. It is also a fact that our population is getting older and with age comes a decrease in strength and dexterity.

While homeowners like the convenience of a motorized device for cleaning, polishing or sanding, they would prefer having a single piece of equipment that is capable of accomplishing a variety of tasks, eliminating the necessity of buying and storing several appliances. Since different tasks are best accomplished with different scrubbing motions, it would be desirable if the device had interchangeable heads, one capable of a back and forth motion, another for rotary motion and so forth.

SUMMARY OF THE INVENTION

In view of the above, it is an object of the present invention to provide a motorized scrubbing device wherein a treatment head linearly reciprocates a pad or brush with a purely translational motion. It is another object to provide a motorized device, that in addition to linear motion, has interchangeable treatment heads imparting rotary, orbital, oscillatory or the like motion. It is also an object to provide a single appliance capable of a variety of cleaning, polishing or sanding actions, required or best-suited to different tasks about a kitchen or workshop. Other objects and features of the invention will be in part apparent and in part pointed out hereinafter.

The invention described below comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
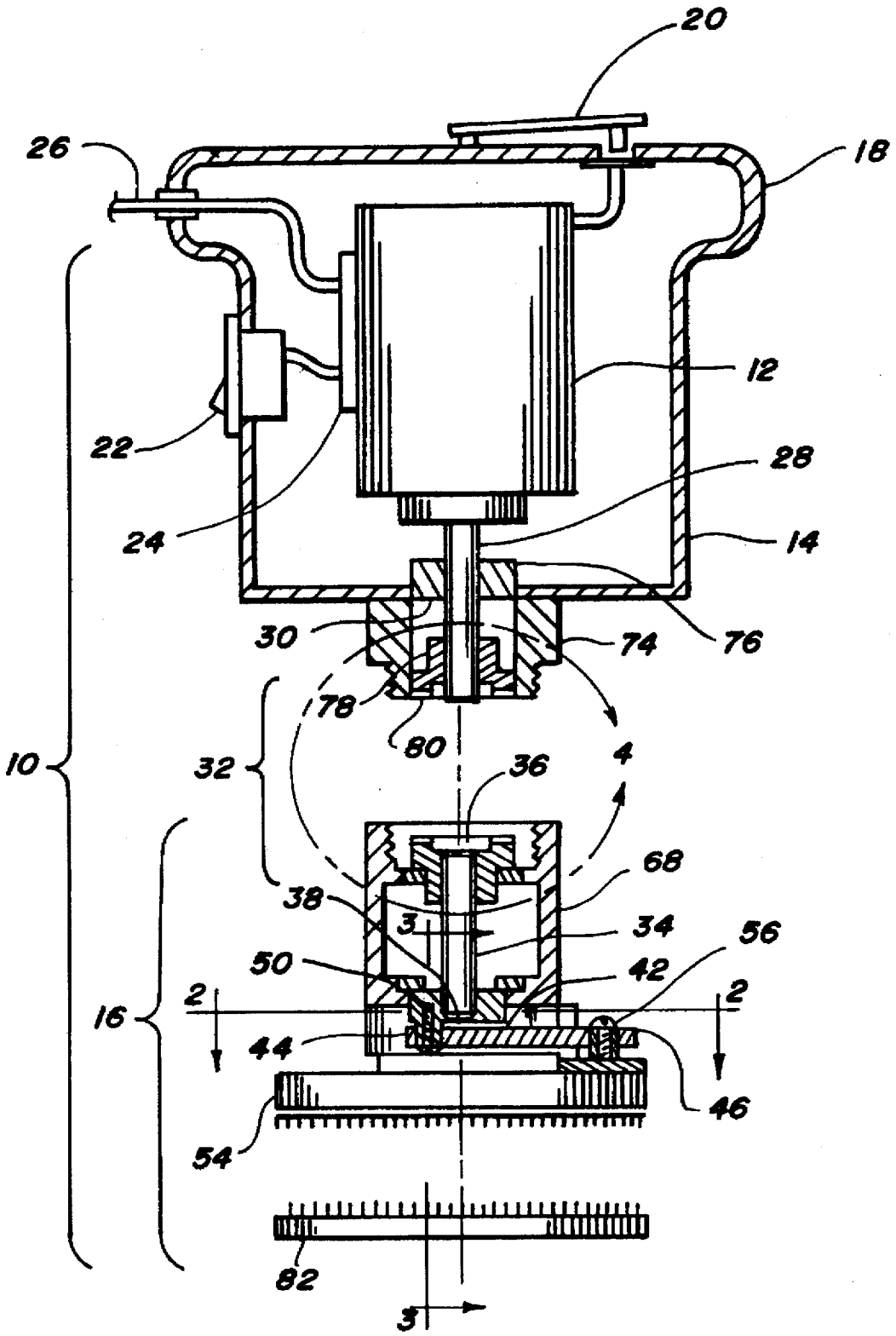
FIG. 1 is an exploded side view in section of a device for cleaning, polishing or sanding in accordance with the present invention, including a detachable treatment head for imparting purely translational motion to a scrubbing pad.
Figure 2:
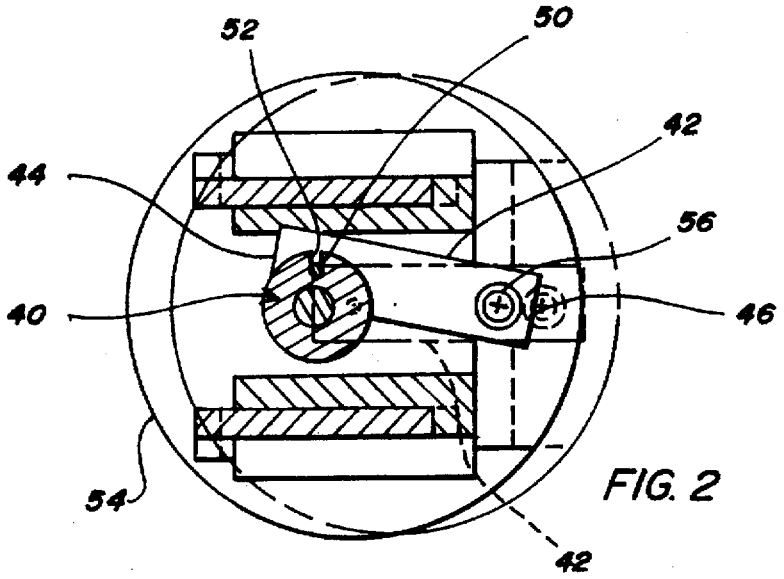
FIG. 2 is a section on a larger scale taken along line 2—2 in FIG. 1.
Figure 3:
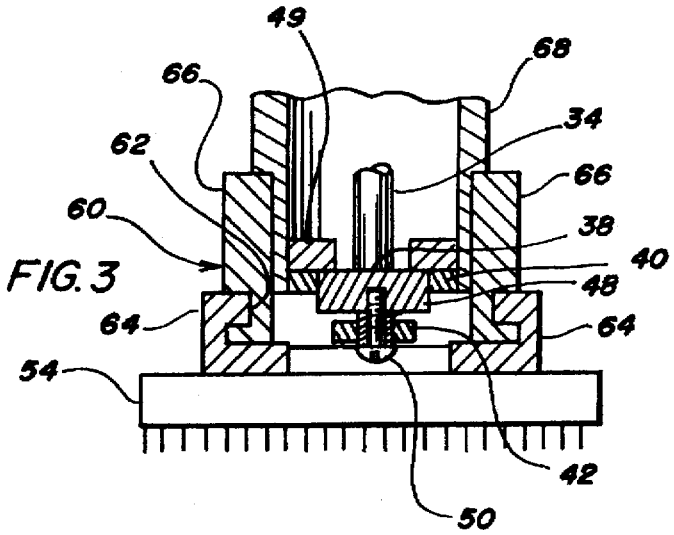
FIG. 3 is a section on a larger scale taken along line 3—3 in FIG. 1.

Referring to the drawings more particularly by reference character, a device 10 for cleaning, polishing or sanding in accordance with the present invention in principal part includes a housing 14 for an electric motor 12 and a treatment head 16, said head preferably interchangeable with a set of treatment heads as more particularly described below.

As shown in FIGS. 1–4, housing 14 is configured to fit the palm of a grasping hand. An encircling extension 18 may be provided for better feel. Housing 14 is preferably waterproof and supports electric motor 12 which is responsive to an automatic electric pressure switch 20. Such automatic pressure switch 20 is designed and situated in a manner that when a user grasps housing 14, pressure from the palm of his or her hand activates electric motor 12. An electric cord 26 is connected to electric motor 12, preferably through a ground fault circuit interrupter (not shown), even so, device 10 is not intended in most instances to be immersed in water. A rheostat switch 22 leading to a rheostat 24 may be provided for selectively controlling the speed of the motor. Because of the amount of power needed, it is preferred that electric motor 12 be powered from a 110 volt household outlet, it being understood, however, that a battery may be used in some instances. In which case, cord 26 can be eliminated or detached, depending on the nature of electric motor 12. Electric motor 12 has an output shaft 28 with a free end extending through a hole 30 provided in housing 14. When treatment head 16 is detachable, as more particularly described below, a coupling 32 is provided for detachably coupling the head.

With continuing reference to FIGS. 1–4, treatment head 16 includes a driven shaft 34 with first and second ends 36, 38, respectively, it being understood that driven shaft 34 may be an extension of output shaft 28 when treatment head 16 is not detachable. In the form illustrated, treatment head 16 is detachable and the first end of driven shaft 34 is coupled inline to the free end of output shaft 28. While the second end of driven shaft 34 is attached inline to a fixed end of crank 40. A connecting link 42 has first and second ends 44, 46, the first end of which is attached to the free end of crank 40. Crank 40 rotates with driven shaft 34 and may take the form of a hub 48 mounted on a bearing 49 attached to the second end of driven shaft 34 with an offset pin 50 for attachment of the connecting link 42, about which it can pivot. The length of the linear stroke of the treatment head is determined by the length of crank 40 and a slot 52 seen in FIG. 2 or a series of holes may be provided for varying the distance of pin 50 from the center of hub 48 thereby controlling the length of the stroke.

Second end 46 of connecting link 42 is attached to a sliding block 54 is unitary and with a second pin 56. Sliding block 54 has a top and a bottom side with connecting link 42 pinned to the top side. Rails 60 flank drive shaft 34 and are preferably slotted at 62. Sliding block 54 is preferably provided with tracks 64 upon which sliding block 54 slides in slots 62. Rails 60 are preferably slotted 62 and block 54 provided with tracks 64 upon which sliding block 54 slides in slots 62. In the form illustrated, rails 60 are a pair of opposing legs 66 attached to a sleeve 68, more particularly described hereinafter, with slots 62 in the outboard sides of the legs. Block 54 is a flat plate upon which a pair of opposing U-shaped tracks 64 are mounted with the ends of legs 66 received in the bight of the U's when one leg of the U's is received in slots 62. Other functionally equivalent rail and track arrangements will be apparent, e.g., where the inboard side of legs 66 is slotted, etc. Rails 60 could be a cylinder and tracks 64 could be a piston to form a "mostly" enclosed linear reciprocating unit.

Figure 4:
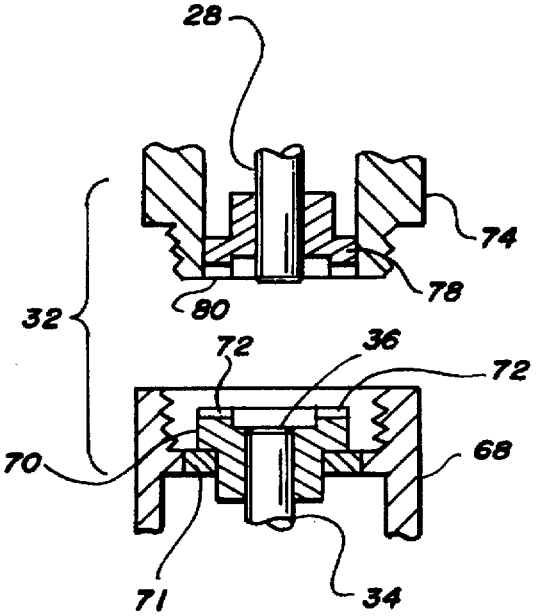
FIG. 4 is a detail on a larger scale taken along line 4—4 in FIG. 1.

As shown in FIGS. 1 and 4, sleeve 68 is a housing within which driven shaft 34 is mounted. Driven shaft 34 is supported within sleeve 68 at the upper end of sleeve 68 in a second hub 70 mounted on a bearing 71, the hub at first end 36 being recessed inside sleeve 68. Second hub 70 has a plurality of projecting teeth 72 like those shown in FIG. 6 and is attached to driven shaft 34. Output shaft 28 is similarly mounted in a second sleeve 74, in a waterproof bearing 76 within which it is journaled. Second sleeve is attached to motor housing 14 about hole 30 through which the free end of the output shaft 28 extends. A third hub 78 with a plurality of projecting teeth 80 is attached to the free end of output shaft 28. Teeth 80 are adapted to mesh with projecting teeth 72 on second hub 70, forming coupling 32 when the first and second sleeves 68, 74 are threaded together bringing the teeth into mesh. Other means for holding the teeth in mesh, including reversing the gender in which sleeves 68, 74 are threaded, bayonet latches, etc. are also within the scope of the present invention.

Figure 5:
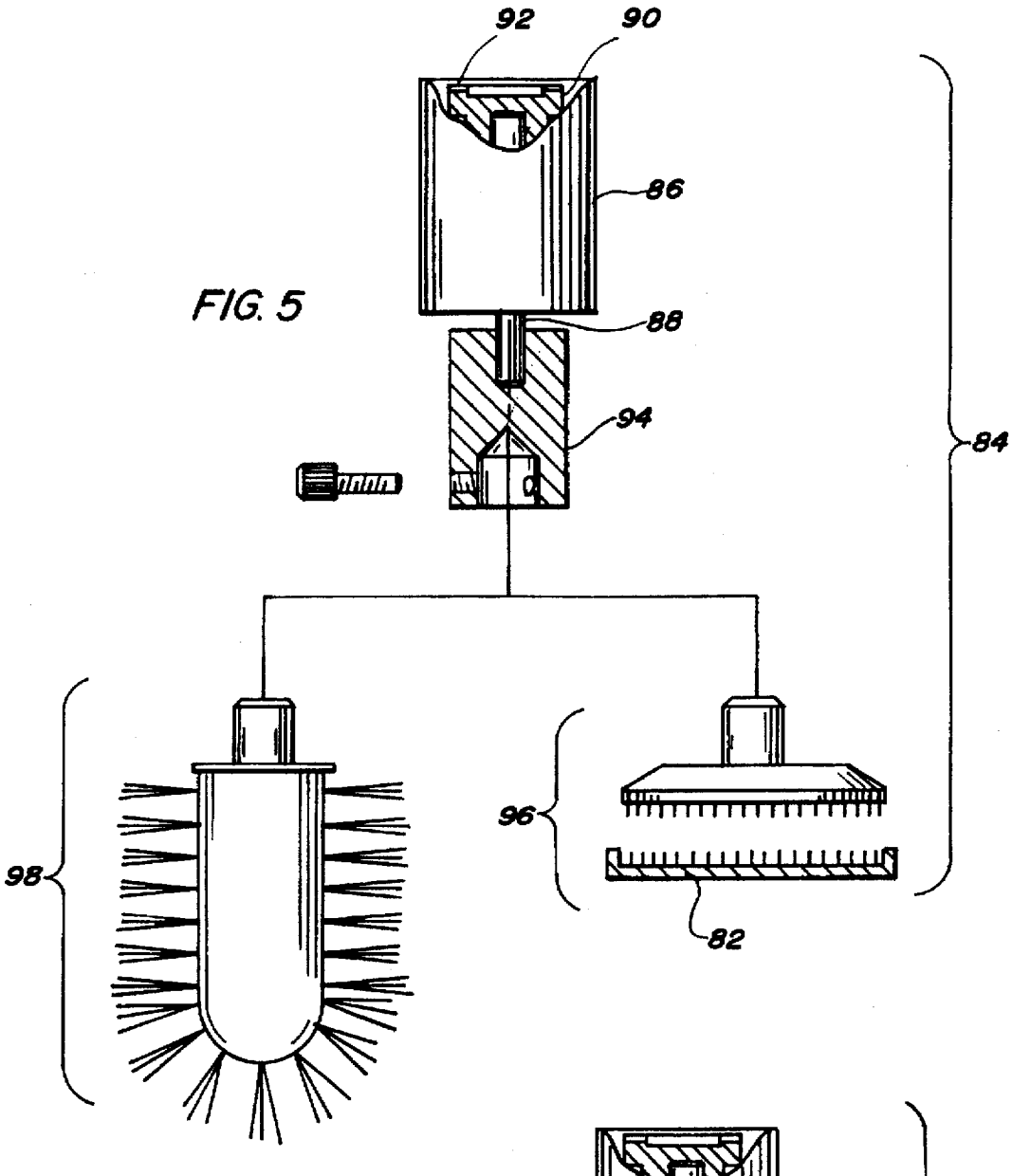
FIG. 5 is an exploded side view, partly in section, of a treatment head for imparting rotary motion to a scrubbing pad or brush.

A cleaning, polishing or sanding pad 82 is attached to the bottom side of sliding block 54 with suitable attachment means such as hook and pile fasteners (e.g., VELCRO), contact adhesives, etc. so that the pad may be readily replaced. For some cleaning purposes, such as cleaning a baking pan, it may be preferred that pad 82 wrap around the sides of plate 54 as shown in FIG. 5. Suitable materials for pad 82 include nylon scouring pads, steel wool, pumice, felt, lambs wool, sponge, sandpaper and so forth, depending upon the application.

In use, when motor 12 is on, the mechanism including crank 40, connecting link 42 and sliding block 54, compels pad 82 to move back and forth with a motion which is that of pure translation. As discussed above, this motion is particularly useful in scrubbing pans, cleaning barbecue grills, sanding "with the grain" and for many other applications. If a rotary motion is needed, treatment head 16 as shown in FIGS. 1–4 can be removed by unthreading first sleeve 68 from second sleeve 74, uncoupling treatment head 16 from output shaft 28.

Figure 7:
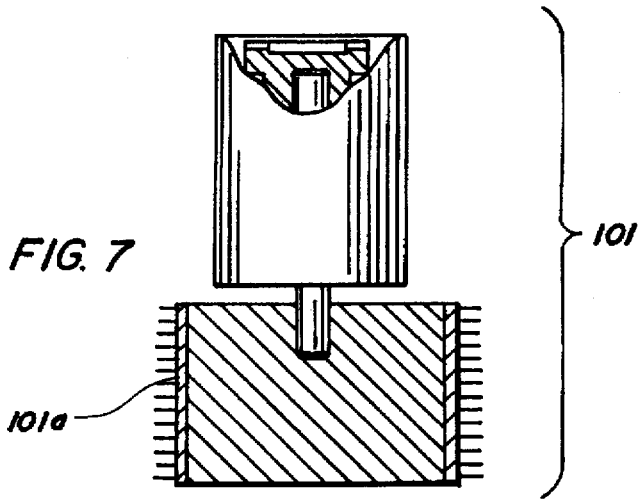

A rotary treatment head 84 as shown in FIG. 5 may be threaded on second sleeve 74. Rotary treatment head 84 includes a housing in the form of a sleeve 86 within which a driven shaft 88 having first and second ends is mounted in hubs, an upper one of which (90) is recessed in sleeve 86 and includes projecting teeth 92 for engagement with projecting teeth 80. An attachment holder 94 is keyed or otherwise attached to the second end of driven shaft 88 for attachment of a scrubbing pad 96 or brush 98 by means of a set screw 100 or the like. Alternatively, as shown in FIG. 7, a rotary treatment head 101 may include a pad 101*a* as an integral portion of the head.

Figure 6:
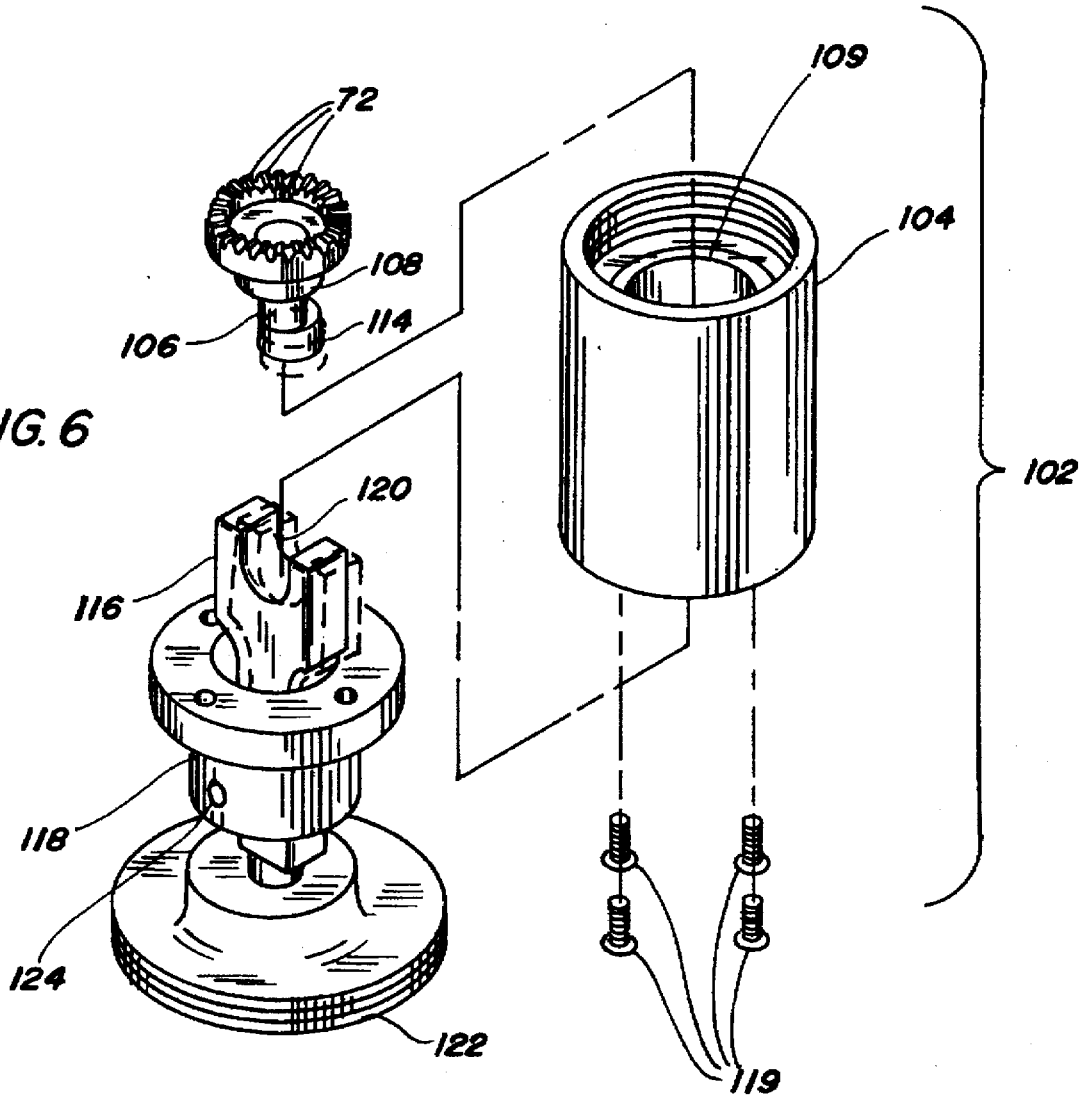
FIG. 6 is an exploded perspective view of a treatment head for imparting oscillatory motion to a treatment pad; and, FIG. 7 is a side view, partly in section, of a second treatment head for imparting rotary motion to a scrubbing pad.

An oscillatory treatment head 102 is shown in FIG. 6 and includes a housing in the form of a sleeve 104 within which is mounted a driven shaft 106 having first and second ends. The first end of the shaft is mounted in a hub 108 mounted in a bearing 109. Hub 108 is recessed in sleeve 102 and has projecting teeth 72 for engagement with projecting teeth on third hub 78. The second end of driven shaft 106 is attached to a cam 114. A connecting link 116 with first and second ends is mounted in an open topped cap 118 with a flange. Cap is attached to the bottom of sleeve 104 with screws 119 through the flange. The first end of connecting link 116 terminates in a yoke 120 engaging cam 114. The second end of connecting link 116 extends beyond the lower end of sleeve 104 and is connected to a block 122. Connecting link 116 is pivoted midway its length about a pin 124. As driven shaft 106 rotates, cam shaped block 114 causes connecting link 116 to pivot about pin 124. As connecting link 116 pivots, a block 122 for attachment of a pad moves back and forth in a slight arc.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A device for cleaning, polishing or sanding comprising an electric motor having an output shaft with a free end;

a crank having a fixed end attached inline to the free end of the output shaft, said crank having a free end;

a connecting link with first and second ends, said first end of the connecting link attached to the free end of the crank;

a unitary sliding block transverse the output shaft having a top and bottom side, said sliding block attached on the top side to the second end of the connecting link;

a pair of spaced apart, parallel side rails flanking the output shaft, said rails having slots within which the sliding block slides back and forth centered about the output shaft;

a cleaning, polishing or sanding pad attached to the bottom side of the sliding block;

whereby the pad is linearly reciprocated as the output shaft rotates, with a motion which is that of pure translation, through a distance that is determined by the length of the crank.

2. The device of claim 1 wherein the output shaft has a longitudinal axis and the sliding block is mounted in the side rails at the free end and transverse the longitudinal axis of the shaft.

3. A device for cleaning, polishing or sanding comprising a first housing with a hole formed therein;

an electric motor mounted in the housing, said motor having an output shaft having a longitudinal axis and a free end extending through the hole in the housing;

a second housing with a driven shaft having a longitudinal axis and first and second ends mounted therein, said second housing having first and second holes with the first and second ends of the driven shaft extending through said holes in the second housing;

an inline coupling for detachably connecting the output shaft to the first end of the driven shaft;

a crank having a fixed end attached inline to the second end of the driven shaft, said crank having a free end;

a connecting link with first and second ends, said first end of the connecting link attached to the free end of the crank;

a unitary sliding block having a top and bottom side, said sliding block attached on the top side to the second end of the connecting link;

a pair of spaced apart, parallel side rails attached to the second housing and flanking the driven shaft, said side rails having slots within which the sliding block slides back and forth centered about the output shaft, said sliding block mounted in the side rails beneath and transverse to the longitudinal axis of the driven shaft;

a cleaning, polishing or sanding pad attached to the bottom side of the sliding block;

whereby the pad is linearly reciprocated as the output shaft rotates, with a motion which is that of pure translation, through a distance that is determined by the length of the crank.

4. The device of claim 3 wherein the coupling for detachably connecting the output shaft to the first end of the driven shaft comprises a first hub with projecting teeth attached to the free end of the output shaft, a second hub with projecting teeth attached to the first end of the driven shaft, said teeth adapted to mesh, and a mechanism for holding the teeth in mesh.

5. The device of claim 4 wherein the mechanism for holding the teeth in mesh comprises first and second sleeves which are threaded together, said first sleeve attached to the first housing about the hole through which the free end of the output shaft extends, said projecting teeth on the first hub being recessed within the first sleeve, said second sleeve being the second housing through which the first end of the driven shaft extends, said projecting teeth on the second hub being recessed within the second sleeve.

6. The device of claim 5 wherein the first and second sleeves are cooperatively threaded to bring the projecting teeth on the first and second hubs into mesh.

7. The device of claim 6 wherein a pressure switch is provided on the first housing for actuating the motor when a user grasps the device in the palm of his or her hand.

8. The device of claim 7 wherein a rheostat is provided for selectively controlling the speed of the motor.

* * * * *